US005129147A

United States Patent [19]

Austin et al.

[11] Patent Number: 5,129,147

[45] Date of Patent: Jul. 14, 1992

[54] SLUICE GATE OR PENSTOCK DOOR

[75] Inventors: Eric P. Austin, Sandbach; Robert W. Harper, Stoke-on-Front, both of Great Britain

[73] Assignee: Simon-Hartley Limited, Stoke-on-Tent, England

[21] Appl. No.: 552,822

[22] Filed: Jul. 13, 1990

[30] Foreign Application Priority Data

Aug. 11, 1989 [GB] United Kingdom ..... 8918411

[51] Int. Cl.[5] ..... B23P 17/00

[52] U.S. Cl. ..... 29/897.32; 29/897.3; 52/577

[58] Field of Search ..... 29/897.3, 897.31, 897.312, 29/897.32; 52/576, 577

[56] References Cited

U.S. PATENT DOCUMENTS

| | | | |
|---|---|---|---|
| 1,681,593 | 8/1928 | Pahl | 29/897.3 X |
| 1,693,742 | 12/1928 | Bemis | 52/576 X |
| 1,776,164 | 9/1930 | Nolte | 29/897.3 X |
| 2,744,042 | 5/1956 | Pace | 29/897.32 X |
| 3,108,406 | 10/1963 | Ellis | 29/897.32 X |
| 4,092,197 | 5/1978 | Robbins | 52/309.11 X |
| 4,213,929 | 7/1980 | Dobson | 52/577 X |
| 4,827,690 | 5/1989 | Viger | 52/577 X |

*Primary Examiner*—Timothy V. Eley
*Assistant Examiner*—C. Richard Martin
*Attorney, Agent, or Firm*—Nies, Kurz, Bergert & Tamburro

[57] ABSTRACT

A penstock or sluice gate door constructed by providing a stack of steel tubes (11) preferably of rectangular cross-section, which are stitch welded together at (12). There are added welded side plates (13), a central stainless steel spindle (14) and bolts (18) for lifting equipment, and the so-formed panel is placed in a mould and encapsulated with an impervious material. If desired side and bottom sealing strips (22, 23, 21) may be integrally formed during encapsulation. The resultant door is lightweight and non-corrodible, and its strength is determined by the wall thickness of the tubes (11) which will be selected accordingly.

12 Claims, 2 Drawing Sheets

SLUICE GATE OR PENSTOCK DOOR

This invention concerns sluice gate or penstock doors. Such doors are usually mounted to be slidable vertically within a pair of side frame members and are used to control the flow, usually of water, in an open channel.

Conventionally, such doors are of cast iron or fabricated from stainless steel or a combination of steel and plastics. Mild steel may be used in some cases though this leads to corrosion problems and so a steel door needs regular maintenance and painting.

Seals at the side edges of the door which may be attached either to the door itself or to the side frame members, prevent seepage of the liquid past the door and so there is a close sliding engagement of the seals upon the surface of the door or the frame.

An object of the present invention is to provide a sluice gate door and a method of constructing same with reduced cost and in certain cases with less weight.

According to the present invention, there is provided, a method of constructing a penstock or sluice gate door comprising the steps of providing a plurality of rigid tubes arranged side-by-side with their longitudinal axes parallel, and attaching same together to form a panel, the so-formed panel being encapsulated in a material impervious to air and any liquid with which the door is to come into contact.

Further according to the present invention, there is provided a penstock or sluice gate door comprising a plurality of rigid tubes arranged side-by-side with their longitudinal axes parallel and attached together to form a panel, the panel being encapsulated in a material impervious to air and any liquid with which the door is to come into contact.

An embodiment of the invention will now be described, by way of example only, with reference to the accompanying drawings, in which.

Figure 1:
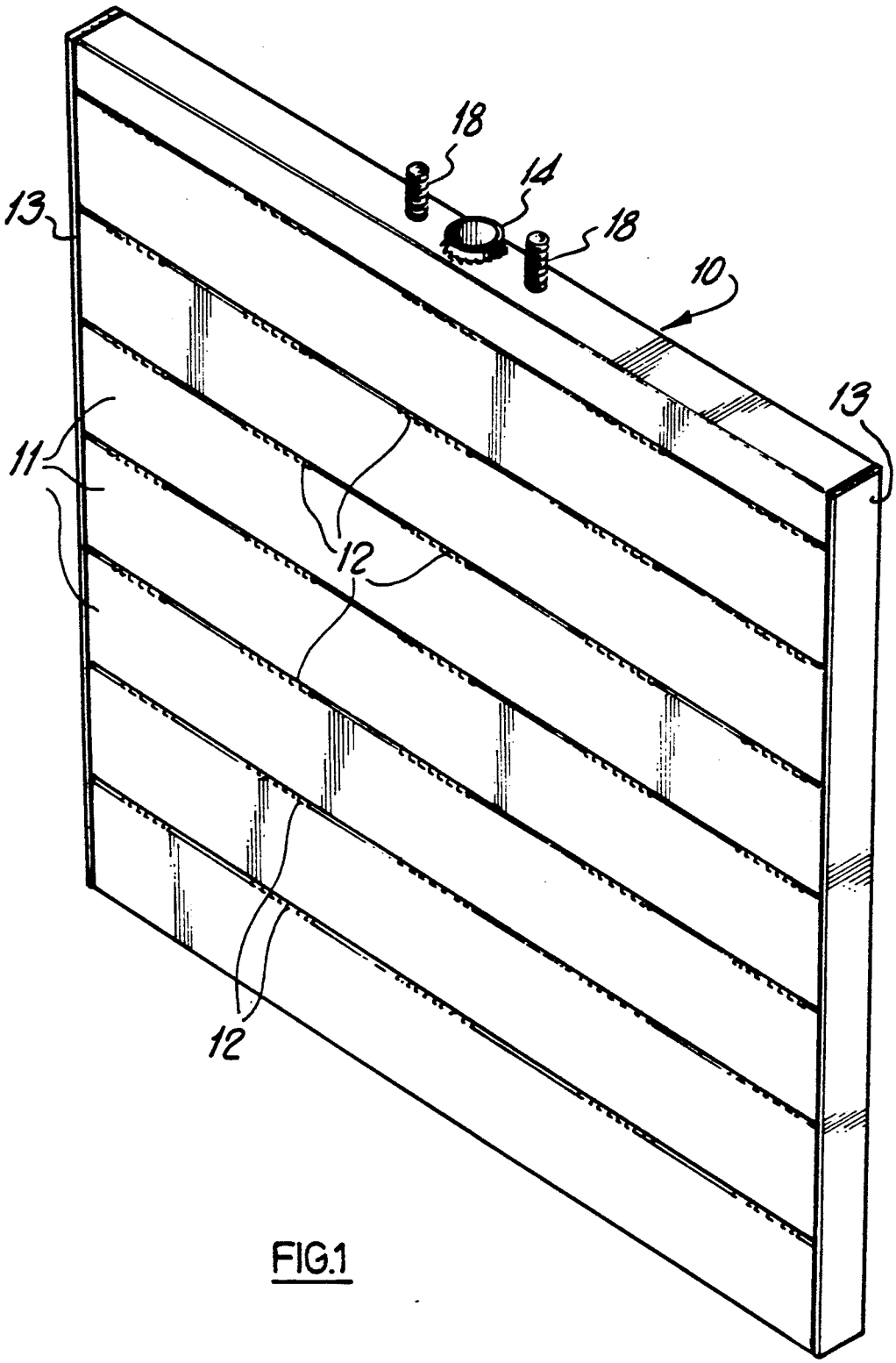
FIG. 1 is a perspective view of a penstock or sluice gate door made in accordance with the invention and illustrated in a penultimate stage of its production.

Referring now to the drawings, a penstock or sluice gate door made in accordance with one embodiment of the invention is produced as a panel 10 by stacking some 7 or 8 lengths of rectangular hollow-sectioned mild steel tube 11 in superimposed abutting relationship with their axes parallel. The tubes 11 are stitch welded together in longitudinally spaced regions as indicated at 12. Side plates 13, or tubes, are welded to the ends of the tubes 11, and extending downwardly through the centre of the so-formed panel 10 is a stainless steel circular section spindle tube 14 which conveniently is welded at 15 (see FIG. 4) to the upper surface of the top tube 11, and similarly to the underside of the bottom tube. Preformed apertures 16 in the upper and lower walls of each tube provide a clearance fit for the central tube 14.

Figure 4:
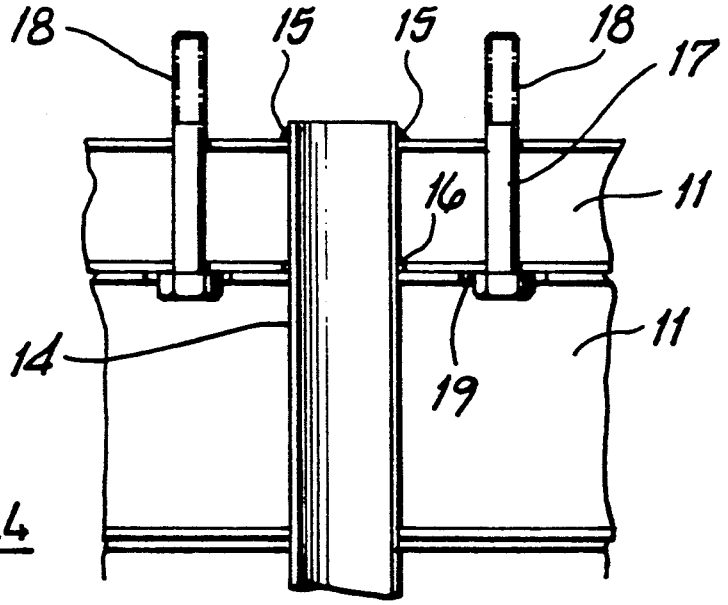
FIG. 4 is a fragmentary vertical cross-section of an upper central region of the door.

As can be seen from FIGS. 1 and 4, bolts 17 are welded at their heads to the underside of the top tube 11 which is bored in its top wall such that the threaded parts 18 of the bolts protrude therefrom for attachment of the door lifting equipment. The top of the second tube down in the stack is bored at 19 to provide a clearance fit for the bolt heads when the tube is assembled.

Once the panel is formed as illustrated in FIG. 1 it is placed in a mould (not shown), and a polymeric material is injected into the latter to form homogeneously around the entire panel 10. Preferably, removable plugs are first placed in the top and bottom of stainless steel tube 14 to prevent the polymeric encapsulating material from entering same.

Figure 2:
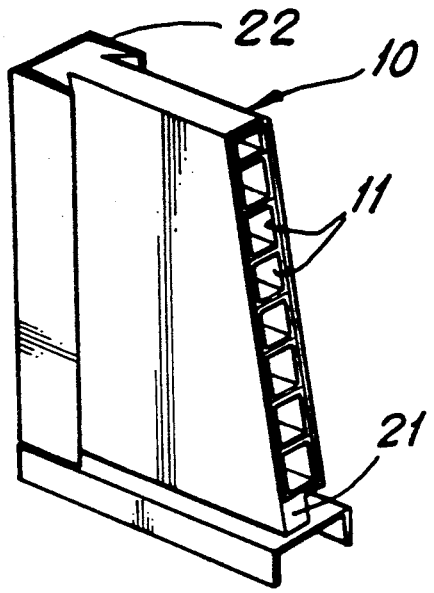
FIGS. 2 and 3 are fragmentary perspective views of part of a finished door with two kinds of side seal attached thereto respectively, and shown seated in its closed position against a bottom frame member.
Figure 3:
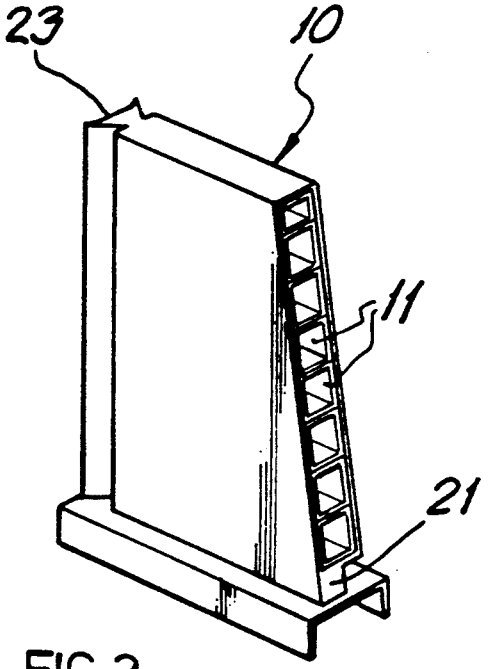

In the process of encapsulation, there may be integrally formed therewith a sealing strip as illustrated at 21 in FIGS. 2 and 3 to extend along the bottom of the finished door, and bear, as shown, against a bottom frame member in use, and side seals for example as illustrated alternatively at 22 and 23 respectively in FIGS. 2 and 3, which will serve to seal the door against adjacent side frame members in use. These sealing strips may be formed entirely from the encapsulating material or alternatively they may be separate strips of two or more materials attached to or located against the side edges of the door prior to injection of the polymer encapsulation, the latter thus locating the strips permanently in their correct positions. The sealing strips may be of a softer plastic material bonded or moulded to the encapsulated door.

The strength i.e. resistance to deflection, of the door is provided by the tubular sections from which it is constructed and this will be determined without affecting the outer dimensions by selecting the thickness of some or all of the walls of the tubes.

Since the entire panel is encapsulated, there is no need for continuous welding between the tubes, the stitch welding 12 being sufficient to maintain the integrity of the panel. Indeed, the welds may be shorter towards the bottom of the door where the vertical lifting loading is progressively reduced.

Various heights of door may be achieved by making up the panel from a number of tubes of different heights so that, for example, all but the two upper tubes may be of one height, whilst the top tube will always be of the same height to accommodate the bolts 17, and the second tube down may be of a selected height in order to meet the overall dimensional requirements. The width of the door will be determined by cutting the tubes to the required lengths.

It is not intended to limit the invention to the above examples only. For example, the tubes may be of other than rectangular section although this latter form is preferable since it will take up the minimum of encapsulating material.

Again, the tubes may be arranged vertically in the door although again the horizontal arrangement is considered preferable since each tube bears against the side frame members as opposed to only the two or perhaps four side edge tubes bearing against the frame members if they are arranged vertically.

If encapsulation is provided by, for example, an epoxy resin, then the tubes may be simply laid in the mould and bonded together by the resin itself. This may then be further encapsulated if necessary with a polymeric material.

In a still further alternative arrangement the tubes may be screwed or riveted together as opposed to welding or bonding.

We claim:

1. A method of constructing a penstock or sluice gate door comprising the steps of placing a plurality of rigid tubes side-by-side with their longitudinal axes parallel, attaching same together in face to face abutting relationship to form a rigid panel, attaching side members across the ends of the tubes to complete the panel, inserting a spindle tube through aligned apertures in the tubes to extend through the length of the panel, attaching said spindle tube to at least one of said side-by-side tubes, and encapsulating the panel in a material impervious to air and liquid.

2. A method according to claim 1, wherein said tubes are attached together by stitch welding applied in longitudinally spaced regions along the line of abutment of each pair of adjacent tubes.

3. A method according to claim 1, wherein said panel is placed in a mould and said encapsulation material is injected into the mould to form homegeneously around the entire panel.

4. A method according to claim 1, wherein, during encapsulating, side and bottom seals are integrally formed along two opposed sides and the bottom respectively of said panel.

5. A method according to claim 1, wherein aid rigid tubes are screwed or riveted together.

6. A method according to claim 1, wherein said tubes are attached together by laying same side-by-side in a mould into which is injected a bonding agent.

7. A method of constructing a penstock or sluice gate door comprising the steps of placing a plurality of rigid tubes side-by-side with their longitudinal axes parallel and horizontal, attaching same together in face-to-face abutting relationship to form a rigid panel, attaching side members across the ends of the tubes to complete the panel, welding a pair of bolts at their heads to the inner wall of one uppermost tube such that said bolts extend through the latter with threaded parts of said bolts protruding upwardly therefrom, and encapsulating the panel in a material impervious to air and liquid.

8. A method according to claim 7, wherein said tubes are attached together by stitch welding applied in longitudinally spaced regions along the line of abutment of each pair of adjacent tubes.

9. A method according to claim 7, wherein said panel is placed in a mould and said encapsulation material is injected into the mould to form homogeneously around the entire panel.

10. A method according to claim 7, wherein, during encapsulation, side and bottom seals are integrally formed along two opposed sides and the bottom respectively of said panel.

11. A method according to claim 7, wherein said rigid tubes are screwed or riveted together.

12. A method according to claim 7, wherein said tubes are attached together by laying same side-by-side in a mould into which is injected a bonding agent.

* * * * *